US006798342B2

(12) United States Patent
Addy

(10) Patent No.: US 6,798,342 B2
(45) Date of Patent: Sep. 28, 2004

(54) SECURITY SYSTEM WITH REMOTE INDICATION DEVICE

(75) Inventor: Kenneth L. Addy, Massapequa, NY (US)

(73) Assignee: Honeywell International Inc., Morristown, NJ (US)

( * ) Notice: Subject to any disclaimer, the term of this patent is extended or adjusted under 35 U.S.C. 154(b) by 78 days.

(21) Appl. No.: 10/180,804

(22) Filed: Jun. 26, 2002

(65) Prior Publication Data

US 2004/0000996 A1 Jan. 1, 2004

(51) Int. Cl.[7] ..... G08B 1/08

(52) U.S. Cl. ..... 340/539.1; 340/524; 340/525; 340/539.16; 340/539.17; 340/545.1; 340/565; 340/691.6; 340/825.36; 340/825.49; 340/286.02

(58) Field of Search ..... 340/506, 524, 340/525, 539.16, 539.17, 545.1, 565, 69.16, 3.1, 825.36, 825.49, 286.02

(56) References Cited

U.S. PATENT DOCUMENTS 3,833,895 A 9/1974 Fecteau
3,866,206 A 2/1975 DeGiorgio et al.
4,023,139 A 5/1977 Samburg
4,092,643 A 5/1978 Stolarczyk
4,257,038 A 3/1981 Rounds et al.
4,692,762 A 9/1987 Lewiner et al.
4,754,255 A 6/1988 Sanders et al.
4,908,604 A 3/1990 Jacob
5,594,428 A 1/1997 Peterson
6,255,944 B1 7/2001 Addy
6,356,192 B1 * 3/2002 Menard et al. ..... 340/539.19

* cited by examiner

*Primary Examiner*—Daryl Pope
(74) *Attorney, Agent, or Firm*—Anthony R. Barkume, P.C.

(57) ABSTRACT

A method and device for providing status of a security system to a user by a remote indication device in response an external stimulus. A status request trigger signal is generated as a result of the stimulus, and status data is then retrieved from an externally located central control unit in response to the status request trigger signal. The status data is then presented via the remote indication device to the user, either by providing a visual display or sounding an audible representation of the status data. The external stimulus may be the motion of a user within proximity of the remote indication device, and the generating of a status request trigger signal may includes the detecting of the motion of the user by a motion detector such as a PIR or a microwave detector.

56 Claims, 3 Drawing Sheets

SECURITY SYSTEM WITH REMOTE INDICATION DEVICE

BACKGROUND OF THE INVENTION

The present invention relates to security systems and in particular to wireless security systems having a remote indication device that provides system status as feedback to a user.

Security systems in use today typically can provide system status via a display console that is permanently mounted near an entry door. It may be desired, however, to implement a remote device, separate and apart from a console, to provide status of the security system to a user. For example, it may be desired to provide such a remote indication device near an alternate entry point that does not have a console in place, without the expense of installing an additional console. In addition, it is desired for the remote indication device to operate in a wireless fashion, thus allowing its location virtually anywhere the installer desires. It is likewise desired to provide such a remote indication device that can provide the latest system status, in real time, without the user having to actively request the status (i.e. without the user having to press a button). For example, it would be highly desirable for a user to be able to obtain system status as he approaches the remote indication device without delay, so that the latest status is displayed just as the user is within viewing distance of the display.

SUMMARY OF THE INVENTION

A first aspect of the invention is a method and device for providing status of a security system to a user by a remote indication device in response an external stimulus. A status request trigger signal is generated as a result of the stimulus, and status data is then retrieved from an externally located central control unit in response to the status request trigger signal. The status data is then presented via the remote indication device to the user, either by providing a visual display or sounding an audible representation of the status data.

In one embodiment, the external stimulus is the motion of a user within proximity of the remote indication device, and the generating of a status request trigger signal includes the detecting of the motion of the user by a motion detector such as a PIR or a microwave detector. In another embodiment, the external stimulus is the opening of a door, and the generating of a status request trigger signal includes detecting the opening of the door, such as by a door closure detection switch or a magnetic reed switch assembly. In another alternative embodiment, the external stimulus is a radio frequency signal generated by a remote control device operated by the user.

The remote indication device normally operates in a reduced power level mode to conserve battery power, and it then switches to an increased power level mode in response to the status request trigger signal. The remote indication device subsequently switches from the increased power level mode back to the reduced power level mode after a timeout period has lapsed.

The status data is retrieved from the central control unit by the remote indication device transmitting a status request signal to the central control unit and then receiving a status signal including the status data from the central control unit. The status data is stored in the remote indication device for a timeout period; it may then be re-presented to the user in response to a subsequent status request trigger signal prior to lapse of the timeout period.

In a second aspect of the invention, the remote indication device is a "listen-only" device; i.e. it does not have an RF transmitter for sending a status request signal to the central control unit. Instead, the central control unit receives the status request trigger signal directly as a result of the external stimulus, and then sends the status data to the remote indication device. Thus, in this second aspect, the invention is a security system and method of operation that includes a central control unit, a remote indication device in wireless communication with the central control unit, and a plurality of security system peripheral devices in communication with the central control unit. As a result of a stimulus external to the central control unit, a status request trigger signal is generated by a security system peripheral device in communication with the central control unit. The central control unit receives the status request trigger signal from the peripheral device, and then it transmits an RF status signal including the status data of the security system. The remote indication device receives the RF status signal and extracts the status data from the status RF signal. The remote indication device then presents the status data to the user.

The peripheral device generating the status request trigger signal may be a motion detector in communication with the central control unit, wherein the stimulus external to the central control unit is the motion of a user within proximity of the motion detector. The method peripheral device may also be a door closure detection switch or a magnetic reed switch in communication with the central control unit, wherein the stimulus external to the central control unit is the opening of a door being monitored by the door closure detection switch or magnetic reed switch.

The peripheral device may also be a remote control device operated by the user, wherein the stimulus is an RF remote control signal generated by the remote control device. The remote indication device may be adapted to receive the status request trigger signal transmitted by the peripheral device. The remote indication device may normally operate in a reduced power level mode, wherein the remote indication device switches to an increased power level mode in response to receiving the status request trigger signal from the peripheral device. The remote indication device would then switch from the increased power level mode to the reduced power level mode after a predetermined time has expired.

DETAILED DESCRIPTION OF THE PREFERRED EMBODIMENT

Figure 1:
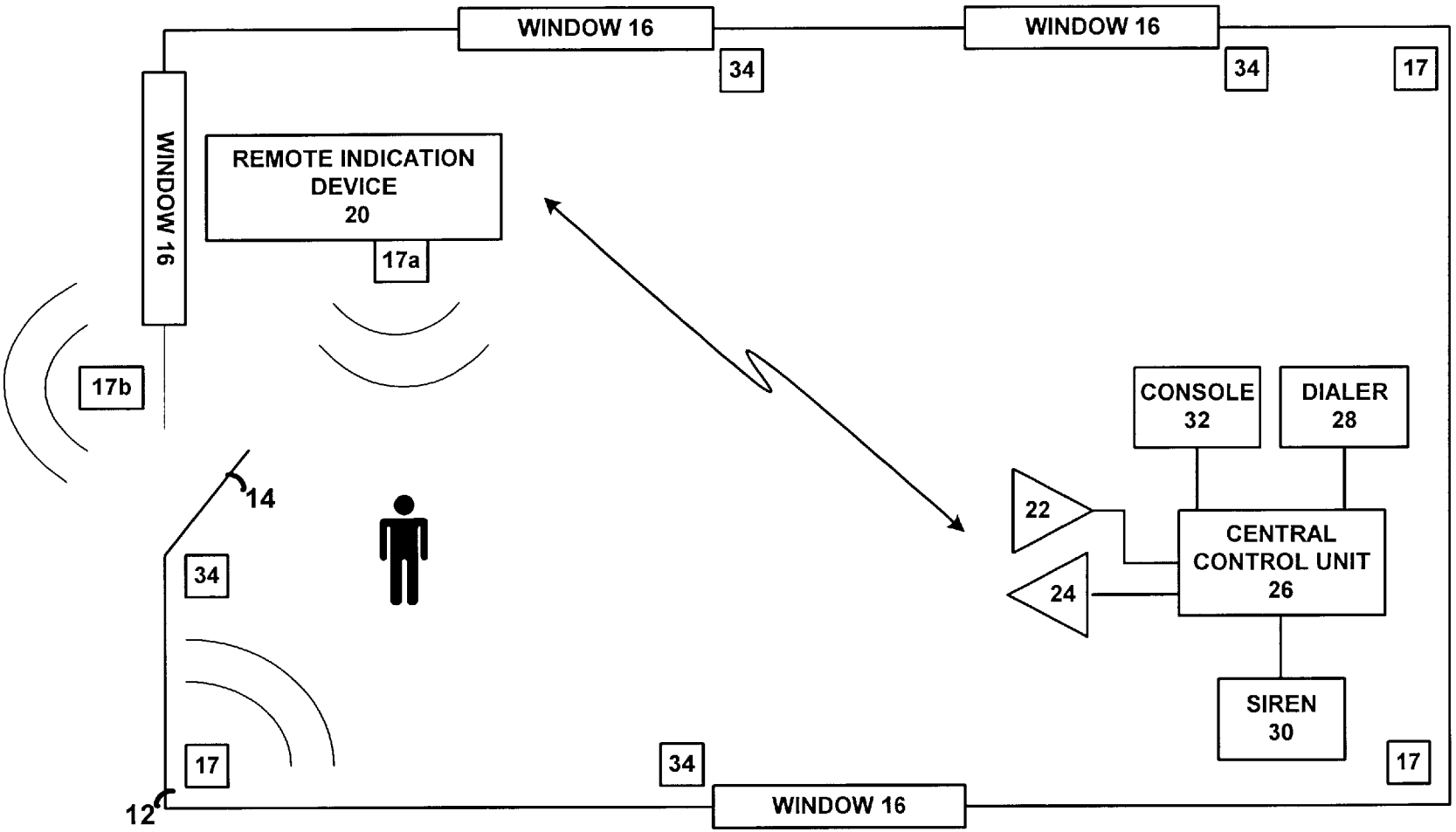
FIG. 1 illustrates a block diagram of a building utilizing a wireless security system in accordance with the present invention.

FIG. 1 illustrates the application of a wireless security system in a building 12 comprising at least one door 14 and a plurality of windows 16. The wireless security system comprises a remote indication device 20, a central control unit 26, and peripheral devices such as alarm sensors 34 located at each door 14 and window 16. Other prior art alarm sensors such as motion detectors 17 may be connected to the system as desired to monitor motion or detect changes in state inside the facility. The alarm sensors 34, 17 detect entry into the doors 14 and windows 16 or motion within the facility by any of various means well known in the art (e.g., closure detectors; magnetic reed switches) and transmit signals representing this to the central control unit 26 by a wired and/or wireless connection as well known in the art.

The security system also includes a central receiver 22 and a central transmitter 24 for enabling communication by the central control unit with the remaining components of the system. A central station dialer 28, a siren 30, and a console 32 are also shown interconnected to the central control unit as well known in the art.

Figure 2:
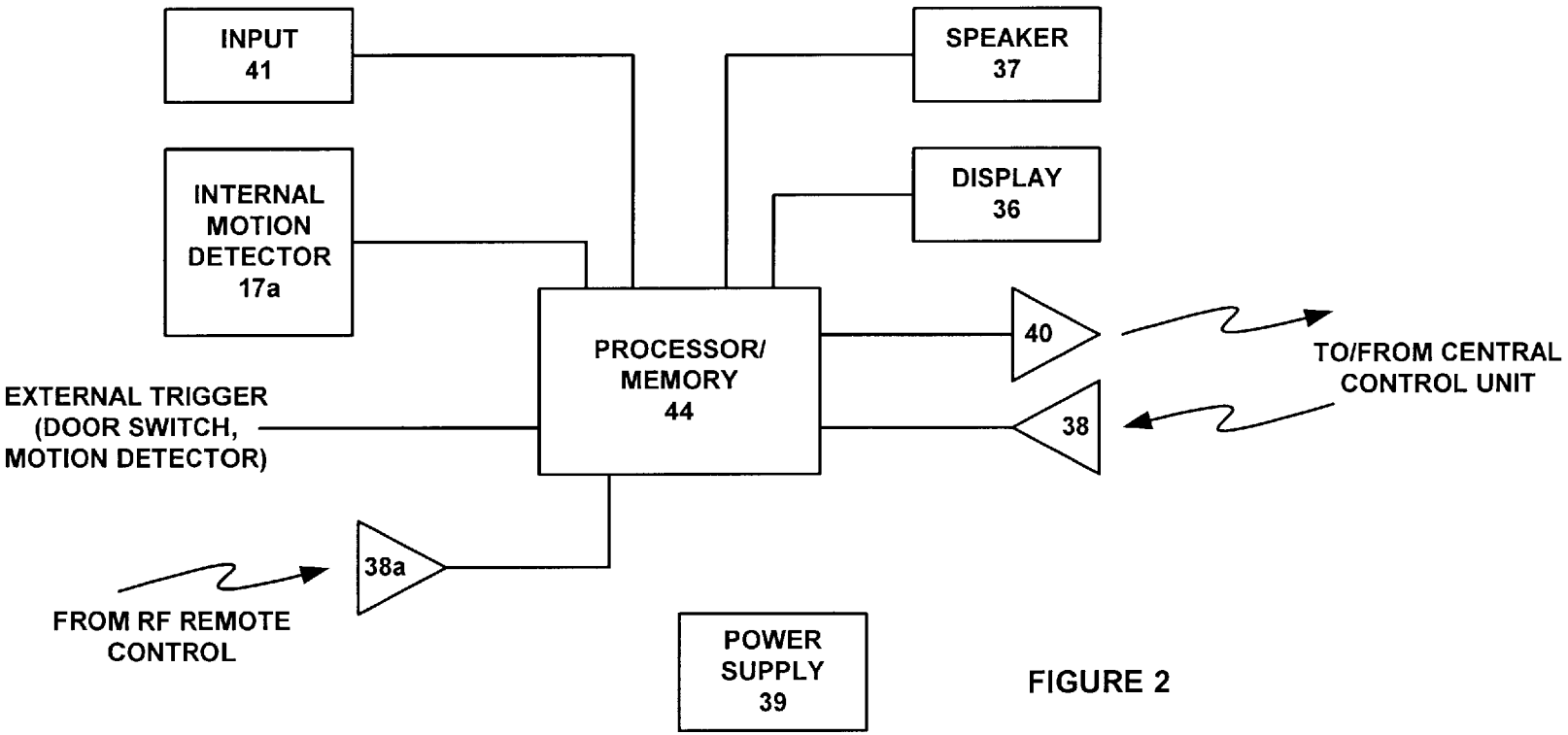
FIG. 2 illustrates a block diagram of the components of the remote indication device of the present invention.

As shown in FIG. 2, the remote indication device 20 includes an a processor/memory unit 44, a means for presenting status to a user including a display 36 and/or a speaker 37, a receiver 38 for receiving data from the central control unit, a transmitter 40 for transmitting data to the central control unit and a power supply 39 such as a battery. The processor 44 includes several inputs for status request trigger signals, such as from an internal motion detector 17*a* and from an external device such as a door closure switch, magnetic switch, or external motion detector.

The remote indication device 20 is generally located in such a way as to permit the user to access it before or soon after entering a building to read the display 36 (and/or listen to the speaker 37) and may include input means 41 such as a keypad to disarm or otherwise interact with the alarm system. The motion detector 17*a* is included in the remote indication device 20 to recognize when a user approaches the console and generate a status request trigger signal to send to the central control unit. The sensitivity of the motion detector may be modified to affect the range of detection of the motion detector. In the preferred embodiment, the motion detection range should be set to be activated between 40 to 0 feet.

The remote indication device 20 normally operates in a reduced power level mode while waiting for a trigger signal from the motion detector 17*a* (or from an external source) where only the sensor circuit and processor are initially enabled. When the motion detector 17*a* is activated, power is enabled to the circuitry of the remaining components of the remote indication device 20. In one embodiment, the circuit first directs power to the transmitter 40 to request status information from the central control unit via an RF signal. After transmission, power is then directed to the receiver 38 to receive the status data signal from the central control unit. In another embodiment, the transmitter and receiver are activated simultaneously in response to a disturbance indicated by the motion detection sensor 17*a*. Since the motion detector 17*a* indicates a disturbance when the user is at some distance from the remote indication device 20, the remote indication device 20 has time to wake and switch to the increased power level mode in order to transmit a request for status. By the time the user gets to the remote indication device 20 the status information is indicated upon a display 36 or is processed by the processor 44 for delivery to the display 36 contained therein.

Ideally, the remote indication device 20 is entirely wireless and operates from a battery, shown as the power supply 39. A completely wireless remote indication device 20 is significantly easier and less costly to install than one requiring AC power. In addition, an optimal mounting location, in terms of radio frequency propagation and motion detection visibility for the remote indication device may be chosen for the device without regard to the location of a low voltage or AC power source. However, in order to operate solely on batteries the device must draw a minimum of current. The range of reduced current receivers is typically very poor and such receivers cannot generally operate at high sensitivity. The remote indication device 20 of the present invention does not need to receive signals from all of the wireless sensors 34, 17 in an alarm system. It only needs to transmit and receive the intermittent status requests and status messages to and from the central control unit. The receiver 38 may therefore, be chosen based on the signal strength of the central transmitter 24 and the expected distance of the device from the central transmitter or auxiliary transmitters.

Figure 3:
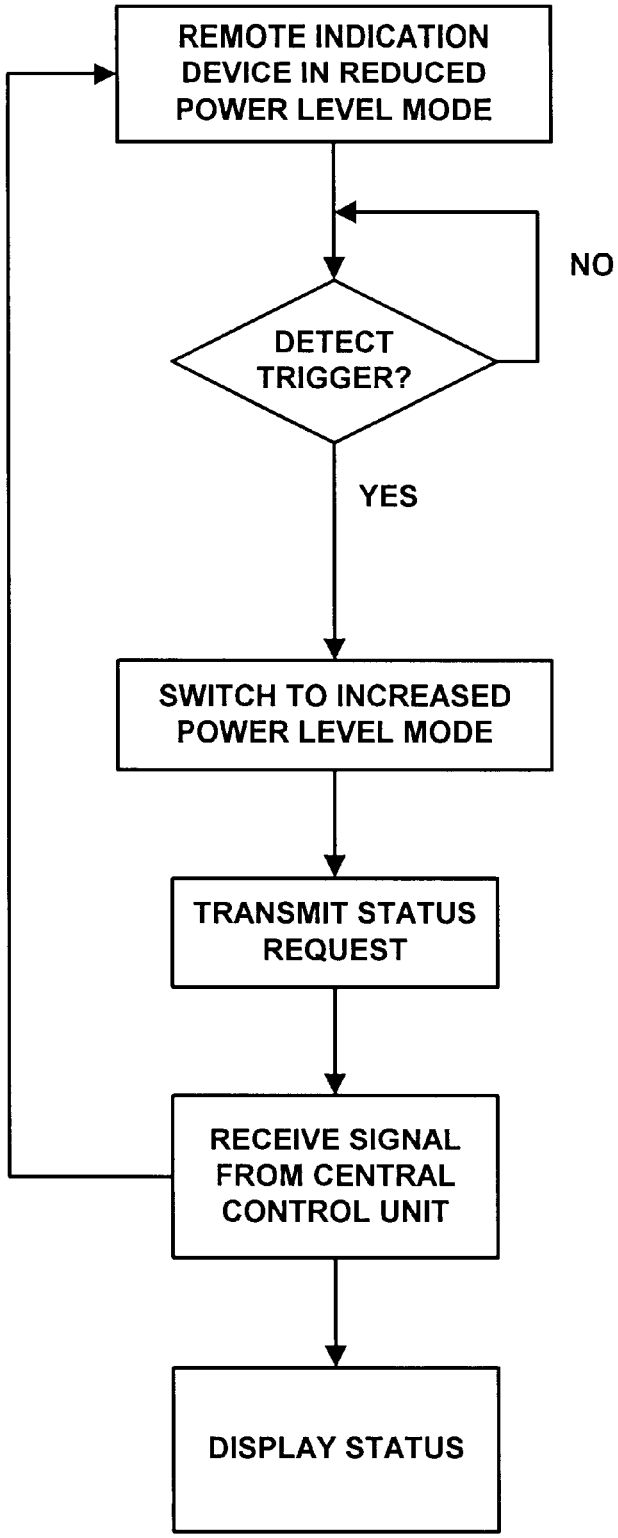
FIG. 3 is a data flow diagram of the process utilized by the wireless security system of the present invention.

FIG. 3 will be used to refer to the process steps performed by the processor unit of the remote indication device. The motion detection sensor is a very low current design that is substantially continuously enabled. The motion detector 17*a* is typically a low-cost passive infrared (PIR) detection device, or a microwave based sensor or equivalent design well known in the art capable of indicating a disturbance in the field of view. When the sensor detects motion by an approaching user, the system switches to the increased power level mode and wakes the transmitter 40 in the remote indication device 20. A status request is sent by the transmitter 40 to the central control unit 26. The receiver 38 is enabled and optionally the transmitter 40 may be disabled. A status signal is generated by the central control unit 26 and is routed through the transmitter 24 of the central control unit 26. The receiver 38 of the remote indication device 20 receives the signal and processes the incoming status information. In a simplified implementation of this invention, the status information is received by the receiver 38 of the remote indication device 20 and is displayed on the display panel 36 of the remote indication device The receiver 38 is typically a superheterodyne receiver, which consumes too much current to be enabled during the reduced power level mode. However, since the receiver 38 is enabled for only a relatively short time during the increased power level mode, the remote indication device 20 may continue to operate entirely from battery 39. The central control unit 26 transmits an RF status data signal to the remote indication device 20 via the central transmitter 24, which is received by the receiver 38. As a consequence of this message, the remote indication device provides an appropriate display to the user for a short period of time after which it shifts back into reduced power level (low-current) mode. Low current mode may be characterized by the disabling of the entire remote indication device 20 with the exception of the motion detection circuit and processor. The remote indication device 20 remains in the reduced power level mode until another signal is received from either the motion detector or an external trigger such as a door contact switch. In a typical scenario, the remote indication device 20 would be mounted so that the motion detection sensor may be activated by the approach of the user.

The remote indication device may use an internally configured motion detector 17*a* as described above, or it may use an external detector 17*b* in the alternative. In this case, an existing detector 17 of the system may be coupled to the remote indication device, wither by a wired connection or a wireless connection (via second receiver 38*a* as shown in FIG. 2). An external motion detector 17*b* may be mounted outside the building to monitor the approach (and perhaps turn on a light as well). Similarly, a door contact switch or magnetic reed switch could be connected (wired or wireless) to the remote indication device so that status data is requested when a user opens the door 14. Any of these events will provide the status request trigger signal as described above.

In addition, in another embodiment that uses the RF remote control device of the applicant's U.S. Pat. No.

6,255,944 (which is incorporated by reference herein) the remote indication device optionally may include circuitry to receive an RF remote control device signal that operates with the second receiver 38*a*. It is required that the enabled second low power receiver 38*a* operate on relatively low current while waiting for transmission of the remote control signal. As previously discussed, upon receipt of the trigger signal from the remote control via a remote radio frequency signal, an increased power level mode is entered wherein the second receiver 38*a* could optionally be disabled while the remainder of the elements of the remote indication device 20 (i.e. the transmitter 40, receiver 38, processing unit 44 and display 36) are enabled as previously disclosed. In the case of receiving a remote control signal at the second receiver 38*a*, the transmitter 40 then transmits a second radio frequency signal representative of the remote control radio frequency signal to the central receiver 22 to perform the functions associated with the remote control. In the alternative to using a separate receiver 38*a*, all of the RF receive functions may be accomplished by a single receiver 38.

Upon receipt of the second radio frequency signal by the central receiver 22, the central receiver 22 transfers information regarding the second radio frequency signal to the central control unit 26. The central control unit 22 then generates a status message and transfers the status message to the central transmitter 24. The status message may comprise information related to the status of the security system or any additional information appropriate for display to the user.

In summary, the user transmits the first remote radio frequency signal via the remote control device, which is received by the second receiver 38*a* in the remote indication device 20 during a reduced power level mode. The remote indication device 20 then switches to the increased power level mode, which enables the first receiver 38, the transmitter 40, the processing unit 44 and optionally disables the second receiver 38*a*. The transmitter 40 then transmits an RF status request signal to the central control unit 26 via the central receiver 22. The central control unit 26 then transmits the status message back to the remote indication device 20 via the central transmitter 24. The remote indication device 20 provides a display of the contents of the status radio frequency signal on the display 36 before returning to the reduced power level mode in which the receiver 38, transmitter 40, display 36, processing unit 44 are disabled and the receiver 38*a* are enabled.

The central transmitter 24 transmits the status message as an RF status signal to the receiver 38 in the remote indication device 20. The processing unit 44 in the remote indication device receives the status message from the receiver 38 and transfers all or a portion of its contents to the display 36 for presentation to the user. At a predetermined time following display to the user the remote indication device 20 will again enter the reduced power level mode by disabling the transmitter 40, receiver 38, processing unit 44, and display 36 in order to conserve battery power.

The remote indication device is generally located in a place convenient to the requirements of the user and/or as dictated by the interconnections with the remaining components of the system. One convenient placement would be to locate the remote indication device so that the display 36 is viewable through an exterior window that is close to the entry door. This will allow a user to see the system status on the display as he approaches the building. In this event, the installer may decide to mount a motion detector 17 on the exterior of the building so that the field of view is the approach to the building. As the user walks towards the entry door, the motion detector will sense the approach and cause the display 36 to present the system status as described above.

The remote indication device can redisplay the contents of the status message within the timeout period by, for instance, storing this information in a temporary location in memory within the processing unit. The power to the temporary memory location could be removed and/or the location could be cleared following the timeout period according to system requirements. Thus, the user is provided with an additional chance to see the display for some period of time while not requiring additional battery power in enabling the transmitter and second receiver.

In the case where a response is not received from the central control unit the remote indication device would indicate that the central control unit was non-responsive. Any or all of the audible or visible status indicators that are part of the presentation means of the remote indication device may be activated if a response is not received from the central control unit in a timely manner or if an unknown device responds to the status request transmission.

In another embodiment of the present invention, a limited range motion detector may also be incorporated into the remote indication device. In this mode of operation the standard motion detector would be used to cause the remote indication device to connect to the central control unit as previously described to request and receive status. If the presentation means of remote indication device contains light emitting devices in addition to a display panel for textual information, the lights may be enabled as a function of the first long-range motion detection sensor. This would allow a distant user to see some type of indication without standing immediately in front of the remote indication device. If the user approaches to within range of the second motion detection unit, the display panel would then be enabled such that it may be read. The power for the second motion detection unit may be enabled as a function of sensing motion at the first motion detection device. In another embodiment, the presentation means may be an audible signal representative of the status information received. For example, a speaker may be enclosed in the remote indication device that will be directed to output preprogrammed voice synthesized sound.

In another embodiment of the present invention, each unit of the system may be given a unique address that may be included in the transmitted signals used by the system. In this manner, if more than one remote indication device is used, the remote indication device that either transmits or receives the broadcast is identified in the signal. This address information may be used by the central control unit to generate a specific message for the addressed remote indication device. The remote indication device may also interpret the message address attached to or embedded in a transmission it receives to determine whether the message is directed to it and may additionally determine where the message was sent from by matching the address of the sending unit to a locally stored address of authorized central control units.

In a second aspect of the invention, the remote indication device operates in a "listen only" mode, meaning that it does not include the RF transmitter 40 and therefore is unable to send a status data request signal to the central control unit. Instead, the central control unit is itself adapted to listen for the status request trigger signal, which will be transmitted from a peripheral device such as a motion detector, door closure switch, magnetic reed switch, or from an RF remote control device. Once the trigger is received, then the status data is sent as an RF message to the remote indication device for display to the user. In this aspect of the invention, the remote indication device may or may not operate in a reduced power level mode as described above. If it does operate in a reduce power level mode, then it will require a wake-up input, which may be in the form of the status request trigger signal itself (for example when the remote indication device is also configured to receive the trigger signal, e.g. from the RF remote control). The remote indication device may also be configured to switch to increased power level mode on actually receiving the RF status data signal from the central control unit so it can present it to the user as desired.

Although the invention has been shown and described with respect to best mode embodiments thereof, it should be understood by those skilled in the art that the foregoing and various other changes, omissions and additions in the form and detail thereof may be made therein without departing from the spirit and scope of the invention.

What is claimed is:

1. In a security system comprising a central control unit located within a premises being monitored, a remote indication device in wireless communication with the central control unit, and a plurality of security system peripheral devices in communication with the central control unit; a method for providing status of the security system to a user, comprising the steps of:

(a) generating, as a result of a stimulus external to the remote indication device, a status request trigger signal at the remote indication device;

(b) the remote indication device retrieving, from the central control unit, status data in response to the status request trigger signal;

(c) the remote indication device presenting the status data to the user;

(d) storing the status data for a timeout period; and (e) re-presenting the status data to the user in response to a subsequent status request trigger signal prior to lapse of the timeout period.

2. The method of claim 1 wherein the stimulus external to the remote indication device is the motion of a user within proximity of the remote indication device, and wherein the step of generating a status request trigger signal comprises the step of detecting the motion of the user.

3. The method of claim 2 wherein the step of detecting motion of a user is implemented with a passive infrared motion detector operably associated with the remote indication device.

4. The method of claim 2 wherein the step of detecting motion of a user is implemented with a microwave motion detector operably associated with the remote indication device.

5. The method of claim 1 wherein the stimulus external to the remote indication device is the opening of a door, and wherein the step of generating a status request trigger signal comprises the step of detecting the opening of the door.

6. The method of claim 5 wherein the step of detecting the opening of the door is implemented with a door closure detection switch operably associated with the remote indication device.

7. The method of claim 5 wherein the step of detecting the opening of the door is implemented with a magnetic reed switch assembly operably associated with the remote indication device.

8. The method of claim 1 wherein the stimulus external to the remote indication device is a radio frequency signal generated by a remote control device operated by the user.

9. The method of claim 1 wherein the remote indication device normally operates in a reduced power level mode, and wherein the remote indication device switches to an increased power level mode in response to receiving the status request trigger signal.

10. The method of claim 9 wherein the remote indication device subsequently switches from the increased power level mode to the reduced power level mode after a timeout period has lapsed.

11. The method of claim 1 wherein the step of presenting the status data comprises the step of providing a visual representation of the status data to the user.

12. The method of claim 1 wherein said step of presenting the status data comprises the step of providing an audible representation of the status data to the user.

13. The method of claim 1 wherein the step of retrieving the status data comprises the steps of:

transmitting a status request signal to the central control unit; and receiving an RF status signal comprising the status data from the central control unit, the status signal transmitted by the central control unit in response to receipt of the status request signal.

14. A remote indication device for providing status of a security system to a user comprising:

means for generating, as a result of a stimulus external to the remote indication device, a status request trigger signal;

means for retrieving, from an externally located central control unit, status data in response to the status request trigger signal;

means for presenting the status data to the user;

means for storing the status data for a timeout period; and means for re-presenting the status data to the user in response to a subsequent status request trigger signal prior to lapse of the timeout period.

15. The device of claim 14 wherein the means for generating a status request trigger signal comprises a motion detector for detecting the motion of a user within proximity of the remote indication device as the stimulus external to the remote indication device.

16. The device claim 15 wherein the motion detector is a passive infrared motion detector operably associated with the remote indication device.

17. The device claim 15 wherein the motion detector is a microwave motion detector operably associated with the remote indication device.

18. The device of claim 14 wherein the means for generating a status request trigger signal comprises a door closure detection switch operably associated with the remote indication device for detecting the opening of a door as the stimulus external to the remote indication device.

19. The device of claim 14 wherein the means for generating a status request trigger signal comprises a magnetic reed switch assembly operably associated with the remote indication device for detecting the opening of a door as the stimulus external to the remote indication device.

20. The device of claim 14 wherein the means for generating a status request trigger signal comprises a remote control device for generating an RF remote control signal as the stimulus external to the remote indication device.

21. The device of claim 14 further comprising means for switching from a reduced power level mode to an increased power level mode as a result of the status request trigger signal.

22. The device of claim 21 further comprising means for switching from the increased power level mode to the reduced power level mode after a timeout period has lapsed.

23. The device of claim 14 wherein the means for presenting the status data comprises a visual display.

24. The device of claim 14 wherein the means for presenting the status data comprises an audible output device.

25. The device of claim 14 wherein the means for retrieving status data comprises:

means for transmitting a status request signal to a central control unit; and means for receiving a status signal comprising the status data from the central control unit, the status signal transmitted by the central control unit in response to receipt of the status request signal.

26. A security system comprising:

a central control unit comprising a first RF transmitter and a first RF receiver;

a plurality of security system peripheral devices in communication with the central control unit to provide signals representative of operating status thereof; and a remote indication device in communication with the central control unit comprising:

trigger generation means for generating a status request trigger signal as a result of an external stimulus;

a second RF transmitter;

a second RF receiver;

a presentation device; and a processor unit operatively coupled to the trigger generation means, the second RF transmitter, the second RF receiver, and the presentation device, the processor unit adapted to cause the second RF transmitter to transmit a status request signal to the first RF receiver of the central control unit in response to the status request trigger signal generated by trigger generation means, to extract status data from a status message received by the second RF receiver from the first RF transmitter; to provide the status data to the presentation device for presentation to the user; to store the status data for a timeout period; and to re-present the status data to the user in response to a subsequent status request trigger signal prior to lapse of the timeout period.

27. The system of claim 26 wherein the trigger generation means for generating a status request trigger signal as a result of an external stimulus comprises a motion detecting module suitable for detecting motion of a user within proximity of the remote indication device.

28. The system of claim 27 wherein the motion detecting module is a passive infrared motion detector.

29. The system of claim 27 wherein the motion detecting module is a microwave motion detector.

30. The system of claim 26 wherein the trigger generation means for generating a status request trigger signal as a result of an external stimulus comprises a door closure detection switch for detecting the opening of a door as the stimulus external to the remote indication device.

31. The system of claim 26 wherein the trigger generation means for generating a status request trigger signal as a result of an external stimulus comprises a magnetic reed switch assembly for detecting the opening of a door as the stimulus external to the remote indication device.

32. The system of claim 26 wherein the trigger generation means for generating a status request trigger signal as a result of an external stimulus comprises a remote control device for generating an RF remote control signal as the stimulus external to the remote indication device.

33. The system of claim 26 wherein the processor unit is further adapted to switch the remote indication device from a reduced power level mode to an increased power level mode as a result of the status request trigger signal.

34. The system of claim 33 wherein the processor unit is further adapted to switch the remote indication device from the increased power level mode to the reduced power level mode after a timeout period has lapsed.

35. The security system of claim 26 wherein the presentation device comprises a visual display.

36. The security system of claim 26 wherein the presentation device comprises an audible output device.

37. In a security system comprising a central control unit located within a premises being monitored, a remote indication device in wireless communication with the central control unit, and a plurality of security system peripheral devices in communication with the central control unit; a method for providing status of the security system to a user, comprising the steps of:

(a) generating, as a result of a stimulus external to the central control unit, a status request trigger signal by a security system peripheral device in communication with the central control unit;

(b) the central control unit receiving the status request trigger signal from the peripheral device;

(c) the central control unit transmitting an RF status signal comprising status data of the security system;

(d) the remote indication device receiving the RF status signal;

(e) the remote indication device extracting the status data from the status RF signal;

(f) the remote indication device presenting the status data to the user;

(g) storing the status data for a timeout period; and (h) re-presenting the status data to the user in response to a subsequent status request trigger signal prior to lapse of the timeout period.

38. The method of claim 37 wherein the peripheral device generating the status request trigger signal is a motion detector in communication with the central control unit, wherein the stimulus external to the central control unit is the motion of a user within proximity of the motion detector.

39. The method of claim 37 wherein the peripheral device generating the status request trigger signal is a door closure detection switch in communication with the central control unit, wherein the stimulus external to the central control unit is the opening of a door being monitored by the door closure detection switch.

40. The method of claim 37 wherein the peripheral device generating the status request trigger signal is a magnetic reed switch in communication with the central control unit, wherein the stimulus external to the central control unit is the opening of a door being monitored by the magnetic reed switch.

41. The method of claim 37 wherein the peripheral device generating the status request trigger signal is a remote control device operated by the user, wherein the stimulus external to the central control unit is an RF remote control signal generated by the remote control device.

42. The method of claim 37 wherein the remote indication device is adapted to receive the status request trigger signal transmitted by the peripheral device, and the remote indication device normally operates in a reduced power level mode, and wherein the remote indication device switches to an increased power level mode in response to receiving the status request trigger signal from the peripheral device.

43. The method of claim 42 further comprising the step of switching the remote indication device from the increased power level mode to the reduced power level mode after a predetermined time has expired.

44. The method of claim 37, wherein said step of presenting said status data comprises the step of providing a visual representation of said status data to said user.

45. The method of claim 37, wherein said step of presenting said status data comprises the step of providing an audible representation of said status data to said user.

46. A security system comprising:

a plurality of security system peripheral devices;

a central control unit in communication with the plurality of security system peripheral devices, and comprising:

means for receiving a status request trigger signal from one of the peripheral devices as a result of a stimulus external to the central control unit, and means for transmitting an RF status signal comprising status data of the security system; and a remote indication device in communication with the central control unit comprising:

an RF receiver;

a presentation device; and a processor unit operatively coupled to the RF receiver and the presentation device, the processor unit adapted to extract the status data from the RF status signal received by the RF receiver from the central control unit; to provide the status data to the presentation device for presentation to the user; to store the status data for a timeout period; and to represent the status data to the user in response to a subsequent status request trigger signal prior to lapse of the timeout period.

47. The system of claim 46 wherein the peripheral device generating the status request trigger signal is a motion detector in communication with the central control unit, wherein the stimulus external to the central control unit is the motion of a user within proximity of the motion detector.

48. The system of claim 47 wherein the motion detector is a passive infrared motion detector.

49. The system of claim 47 wherein the motion detector is a microwave motion detector.

50. The system of claim 46 wherein the peripheral device generating the status request trigger signal is a door closure detection switch in communication with the central control unit, wherein the stimulus external to the central control unit is the opening of a door being monitored by the door closure detection switch.

51. The system of claim 46 wherein the peripheral device generating the status request trigger signal is a magnetic reed switch in communication with the central control unit, wherein the stimulus external to the central control unit is the opening of a door being monitored by the magnetic reed switch.

52. The system of claim 46 wherein the peripheral device generating the status request trigger signal is a remote control device operated by the user, wherein the stimulus external to the central control unit is an RF remote control signal generated by the remote control device.

53. The system of claim 46 wherein the remote indication device is adapted to receive the status request trigger signal transmitted by the peripheral device, and the remote indication device normally operates in a reduced power level mode, and wherein the remote indication device switches to an increased power level mode in response to receiving the status request trigger signal from the peripheral device.

54. The system of claim 46 wherein the remote indication device switches from the increased power level mode to the reduced power level mode after a predetermined time has expired.

55. The system of claim 46, wherein the presentation device is a visual display.

56. The system of claim 46, wherein the presentation device is an audible output device.

* * * * *